US010660457B2

(12) United States Patent
Sun et al.

(10) Patent No.: US 10,660,457 B2
(45) Date of Patent: May 26, 2020

(54) TRANSPARENT WINDOW DISPLAY APPARATUS

(71) Applicants: BOE TECHNOLOGY GROUP CO., LTD., Beijing (CN); HEFEI BOE DISPLAY LIGHTING CO., LTD., Hefei, Anhui (CN)

(72) Inventors: Wenbo Sun, Beijing (CN); Qiping Zhang, Beijing (CN); Dejun Li, Beijing (CN); Sheng Zhang, Beijing (CN)

(73) Assignees: BOE TECHNOLOGY GROUP CO., LTD., Beijing (CN); HEFEI BOE DISPLAY LIGHTING CO., LTD., Hefei, Anhui (CN)

( * ) Notice: Subject to any disclaimer, the term of this patent is extended or adjusted under 35 U.S.C. 154(b) by 400 days.

(21) Appl. No.: 15/522,176

(22) PCT Filed: Oct. 24, 2016

(86) PCT No.: PCT/CN2016/103068

§ 371 (c)(1),
(2) Date: Apr. 26, 2017

(87) PCT Pub. No.: WO2017/118167

PCT Pub. Date: Jul. 13, 2017

(65) Prior Publication Data

US 2018/0084924 A1 Mar. 29, 2018

(30) Foreign Application Priority Data

Jan. 5, 2016 (CN) ..... 2016 2 0019794 U

(51) Int. Cl.

| | |
|---|---|
| ***A47F 3/00*** | (2006.01) |
| ***A47F 11/06*** | (2006.01) |
| ***A47F 11/10*** | (2006.01) |

(52) U.S. Cl.
CPC ..... *A47F 3/001* (2013.01); *A47F 11/06* (2013.01); *A47F 11/10* (2013.01)

(58) Field of Classification Search
CPC ..... F21V 14/02
See application file for complete search history.

(56) References Cited

U.S. PATENT DOCUMENTS 7,207,696 B1 * 4/2007 Lin ..... F21V 14/02 362/232
9,074,749 B2 7/2015 Seo et al.
(Continued)

FOREIGN PATENT DOCUMENTS

CN 103293738 A 9/2013
CN 103426367 A 12/2013
(Continued)

OTHER PUBLICATIONS

International Search Report dated Jan. 22, 2017 in corresponding International Application No. PCT/CN2016/103068 along with an English translation of the International Search Report and an English translation of the Written Opinion of the International Searching Authority.

*Primary Examiner* — Anh T Mai
*Assistant Examiner* — Zachary J Snyder
(74) *Attorney, Agent, or Firm* — Nath, Goldberg & Meyer; Joshua B. Goldberg

(57) ABSTRACT

The present invention provides a transparent window display apparatus, which includes a diffuser plate, in addition to a transparent display screen, a top plate, a back plate, a base and two side walls, the diffuser plate and the back plate form an angle and at least one light source is provided between the top plate and the diffuser plate. By adjusting the light source between the top plate and the diffuser plate, planar light is provided for both show of an exhibit and display of the transparent display screen simultaneously, dual purposes of
(Continued)

window display and advertisement display can be achieved, and meanwhile, costs are saved and efficiency is improved.

20 Claims, 8 Drawing Sheets

(56) References Cited

U.S. PATENT DOCUMENTS

| | | | | |
|---|---|---|---|---|
| 2010/0144432 | A1* | 6/2010 | Nittou | A63F 7/022 463/30 |
| 2013/0314923 | A1* | 11/2013 | Seo | F21V 7/00 362/282 |
| 2014/0198504 | A1* | 7/2014 | Wendt | E04B 9/006 362/249.03 |

FOREIGN PATENT DOCUMENTS

| | | | |
|---|---|---|---|
| CN | 103504881 | A | 1/2014 |
| CN | 103698939 | A | 4/2014 |
| CN | 205321904 | U | 6/2016 |
| JP | 2000-308551 | A | 11/2000 |

* cited by examiner

TRANSPARENT WINDOW DISPLAY APPARATUS

This is a National Phase Application filed under 35 U.S.C. 371 as a national stage of PCT/CN2016/103068, filed Oct. 24, 2016, an application claiming the benefit of Chinese Application No. 201620019794.0, filed Jan. 5, 2016, the content of each of which is hereby incorporated by reference in its entirety.

TECHNICAL FIELD

The present invention relates to the field of display technology, and particularly relates to a transparent window display apparatus for showing items.

BACKGROUND

With continuous development of science and technology and continuous increase of market competition, means for advertising and showing products are developing continuously, and window display, as a type of in-store advertising, is the most common one. When a consumer comes into a store or an exhibition hall, products displayed in a show window will always attract his or her attention at first. A show window is also a window showing brand and grade, and an importance channel promoting products to extremes.

An existing window display that mostly uses light and projection or ornaments to show appearance of a product is accompanied by an advertisement that is displayed in a liquid crystal display apparatus inside a store or a screen on an external wall to promote appearance, performance, and the like of the product, but in most cases, for a consumer who has not bought the product, the two means cannot achieve the predetermined publicity effect at the same time. Therefore, a transparent window display apparatus including a transparent display screen that can simultaneously achieve both window display and advertisement display arises, and such transparent window display apparatus, by the aid of the transparent display screen included therein, can achieve both static window display and dynamic advertisement display. However, the existing transparent window display apparatus can hardly achieve desirable effects of window display and advertisement display.

SUMMARY

Embodiments of the present invention provide a transparent window display apparatus, which can achieve desirable effects of window display and advertisement display.

There is provided a transparent window display apparatus, including a transparent display screen, a top plate, a back plate, a base, a first side wall and a second side wall, wherein the transparent display screen and the back plate are provided opposite to each other and are respectively located on the front and back of the transparent window display apparatus, the base and the top plate are provided opposite to each other and are respectively located at the bottom and top of the transparent window display apparatus, the first side wall and the second side wall are provided opposite to each other and are respectively located on two sides of the transparent window display apparatus, the transparent display screen, the top plate, the back plate, the base, the first side wall and the second side wall form an internal space for accommodating an exhibit, wherein the transparent window display apparatus further includes a diffuser plate in the external space, the diffuser plate and the back plate forming an angle; and a light source between the top plate and the diffuser plate, wherein the diffuser plate is configured to diffuse light emitted from the light source, so as to obtain desirable light to show the exhibit and/or provide backlight for the transparent display screen.

Preferably, optical elements such as lens or prisms arranged periodically are provided on a surface of the diffuser plate facing the light source; and/or the angle between the diffuser plate and the back plate ranges from 60 degrees to 80 degrees.

The light source includes one or more linear light sources. The linear light source may be of a prismatic structure. Specifically, each linear light source is parallel to the diffuser plate and has two ends respectively extending out of the first side wall and the second side wall of the transparent window display apparatus, or when the light source includes at least two linear light sources, the at least two linear light sources are connected in parallel, and two ends shared by the at least two linear light sources connected in parallel extend out of the first side wall and the second side wall of the transparent window display apparatus, respectively. The transparent window display apparatus further includes a knob structure, which is provided on surfaces of the first side wall and the second side wall facing the outside of the transparent window display apparatus and configured to be respectively connected to the two ends to adjust a light-exiting angle of the linear light source. Preferably, the knob structure and the two ends are connected by means of screw threads or jointed by way of plugging and pulling. Particularly, when the light source includes at least two linear light sources, the at least two linear light sources are arranged sequentially in a direction from the back plate to the transparent display screen and between the top plate and diffuser plate, and a distance of the linear light source from the top plate decreases as a distance of the linear light source from the back plate increases. Preferably, the linear light source is an LED lamp.

Preferably, the back plate is a transparent back plate, and the first side wall and the second side wall are transparent side walls.

Inner sides of the transparent display screen and the back plate are respectively provided with a front protrusion and a back protrusion to secure the diffuser plate.

The base is configured to fix the exhibit. Preferably, the transparent display screen is a liquid crystal display screen.

Particularly, an adjustment mechanism is provided on the back plate of the transparent window display apparatus, and the adjustment mechanism can lead out a black elastomer whose tail end is connected to an end of the diffuser plate proximal to the back protrusion, so that the angle between the diffuser plate and the back plate can be adjusted.

The light source may include at least two linear light sources, which are arranged sequentially in a direction from the back plate to the transparent display screen and between the top plate and the diffuser plate, an extended line of the top plate and an extended line of the diffuser plate form an angle, and a line connecting the at least two linear light sources overlaps with on a bisector of the angle.

Inner side of the top plate may be a specular reflection surface.

The linear light source may also be a columnar light source.

The linear light source may also be of a cuboid structure.

A method for adjusting light derived from the diffuser plate in the above-described transparent window display apparatus, including:

adjusting light derived from the diffuser plate by adjusting light intensity and/or a light-exiting angle of light emitted from the light source and adjusting the angle between the diffuser plate and the back plate.

When the light source includes one or more linear light sources, the linear light sources are parallel to the diffuser plate and are of cuboid structures, and the method includes:

in an initial phase, keeping a relatively large surface, which is a light-exiting surface, of the linear light source of a cuboid structure parallel to the diffuser plate, at this point, intensity of light derived from the diffuser plate having a maximum value; and in a use phase, rotating two ends of the linear light source extending out of the first side wall and the second side wall to drive the linear light source to rotate inside the transparent window display apparatus, so that the relatively large surface, which is the light-exiting surface, of the linear light source of the cuboid structure is not parallel to the diffuser plate any more, thereby obtaining desirable light intensity and/or light-exiting angle of light derived from the diffuser plate.

Inside a transparent window display apparatus of the present invention, a light source and a diffuser plate cooperating with each other are provided, by adjusting the light source and/or the diffuser plate, light emitted from the light source is diffused as desired through optical elements provided on a surface of the diffuser plate, so that the diffused light has desirable light intensity and/or light-exiting angle to illuminate the exhibit and provide backlight for the transparent display screen, thereby achieving desirable effects of window display and advertisement display.

REFERENCE NUMERALS

101—transparent display screen; 102—base; 103—back plate; 104—top plate; 105—back protrusion; 106—light source; **106*a*—first protrusion; 106*a*'—second protrusion; 106*b*—screw thread; 106*b*'—pattern; 107—knob structure; 107*a*—screw hole; 107*b*'—slot; 108—diffuser plate; 109—front protrusion; 110—exhibit; 111—first side wall; 112—second side wall; 113—adjustment mechanism; 114**—black elastomer.

DETAILED DESCRIPTION OF THE EMBODIMENTS

A transparent window display apparatus provided by embodiments of the present invention will be described in detail below in conjunction with the accompanying drawings.

Figure 1:
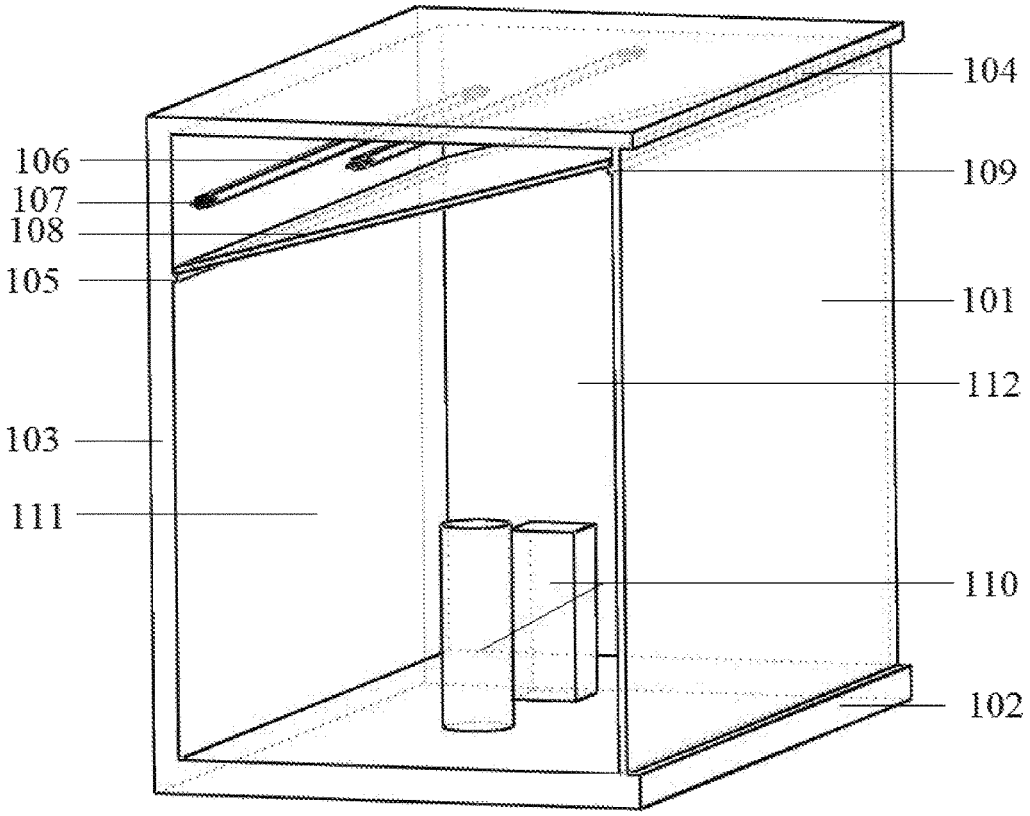
FIG. 1 is a perspective view of a transparent window display apparatus provided by an embodiment of the present invention.
Figure 2:
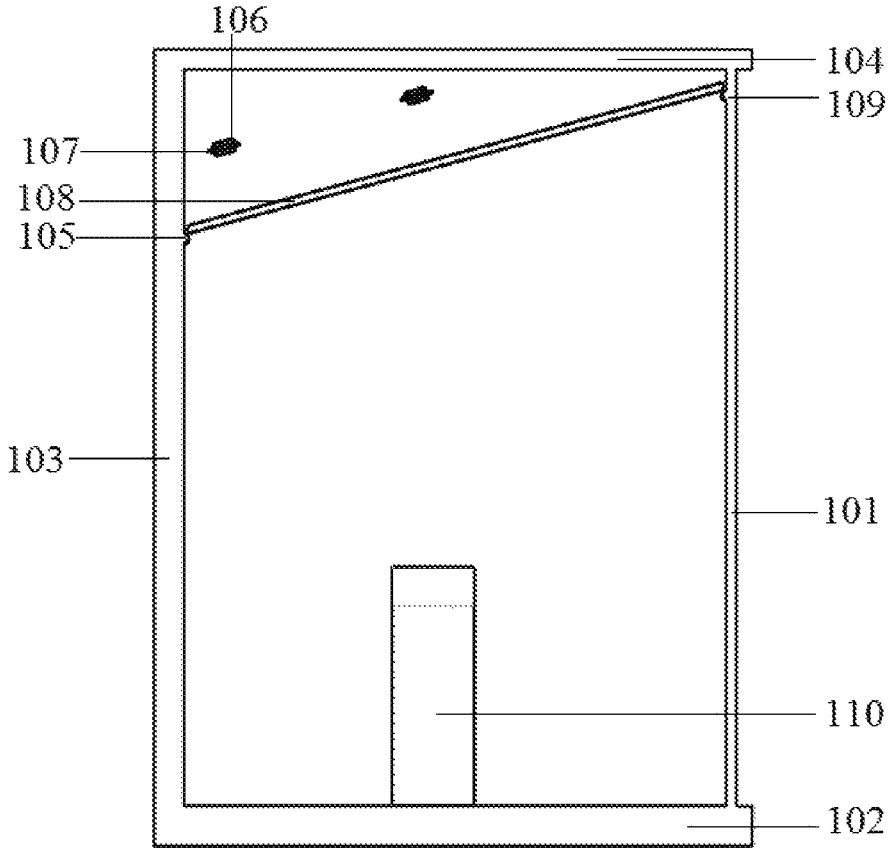
FIG. 2 is a side view of a transparent window display apparatus provided by an embodiment of the present invention.

Embodiments of the present invention provide a transparent window display apparatus, which, as shown in FIG. 1, includes a transparent display screen 101, a base 102, a back plate 103, a top plate 104, a back protrusion 105, a light source 106, a knob structure 107, a diffuser plate 108, a front protrusion 109, a first side wall 111 and a second side wall 112. The side view of the transparent window display apparatus shown in FIG. 2 illustrates positional relationship among the parts included therein more clearly. The transparent display screen 101 is located on a side of the transparent window display apparatus facing a viewer, i.e., located on the obverse side of the transparent window display apparatus, the back plate 103 is provided opposite to the transparent display screen 101 and located on the back of the transparent window display apparatus, the base 102 is located at the bottom of the transparent window display apparatus and opposite to the top plate 104, and the first side wall 111 and a second side wall 112 are located at two sides and opposite to each other. The transparent display screen 101, the base 102, the back plate 103, the top plate 104, the first side wall 111 and the second side wall 112 form an internal space for accommodating and fixing an exhibit.

Generally, the base 102 is configured to accommodate and fix an exhibit 110, as shown in FIG. 1, but the present invention is not limited thereto, and the exhibit 110 may be placed and fixed in the internal space of the transparent window display apparatus by other means. The light source 106 is between the top plate 104 and the diffuser plate 108. The front protrusion 109 and the back protrusion 105 are respectively provided on inner sides of the transparent display screen 101 and the back plate 103 to fix the diffuser plate 108 and prevent it from falling off. Optical elements such as lens or prisms arranged periodically are provided on a surface of the diffuser plate 108 to diffuse light emitted from a light source such as a point light source or a linear light source to generate desirable light such as planar light.

The diffuser plate 108 is provided slantwise in the internal space of the transparent window display apparatus, and forms an angle with the back plate 103. Preferably, the angle is set to be in the range of 60 degrees to 80 degrees. With the angle in this range, storage space inside the transparent window display apparatus can be maximized and in the meanwhile, better cooperation with the light source can be realized, thus achieving better visual effect.

The light source 106 between the top plate 104 and the diffuser plate 108 is preferably a linear light source. Compared with a point light source, a linear light source may achieve higher light intensity. The linear light source may be, for example, a columnar light source. Particularly, the linear light source may be of a prismatic structure. In a case where the linear light source is of a prismatic structure, different surfaces of the prismatic structure have different light-exiting angles, also, light finally reaching the diffuser plate 108 has different light intensities and light-exiting angles, and therefore different light intensities and light-exiting angles can be provided for show of the exhibit 110 and display of the transparent display screen 101 in the transparent window display apparatus.

Preferably, the linear light source is parallel to the diffuser plate 108 and is of a cuboid structure, and two ends of the linear light source extend out of the first side wall and the second side wall of the window display apparatus, respectively, that is, a part of the linear light source is located outside a window body of the window display apparatus. Because the linear light source is of an integral structure, the light-exiting angle of light emitted from the linear light source inside the window display apparatus as well as the light intensity and light-exiting angle of light finally reaching the diffuser plate 108 can be adjusted conveniently when the part of the linear light source outside the window body of the window display apparatus is rotated, thereby obtaining an optimum display effect. In a case where the linear light source is of a cuboid structure, an initial positional relation is set in such a manner that a relatively large surface (light-exiting surface) of the linear light source of a cuboid structure is kept parallel to a plane of the diffuser plate 108, at this point, intensity of light derived from the diffuser plate 108 is maximum, a light-exiting direction is perpendicular to the plane of the diffuser plate 108, and brightness of light reaching the exhibit 110 on the base is maximum. In practical use: the two ends of the linear light source extending out of the first side wall and the second side wall may be rotated by way of flicking or twisting, so as to drive the linear light source to rotate inside the window display apparatus, so that the relatively large surface (light-exiting surface) of the linear light source of a cuboid structure is no longer parallel to the plane of the diffuser plate 108, as a result, intensity of light derived from the diffuser plate 108 is decreased, the light-exiting angle is changed, and brightness of the light reaching the exhibit 110 on the base 102 is decreased.

Figure 3:
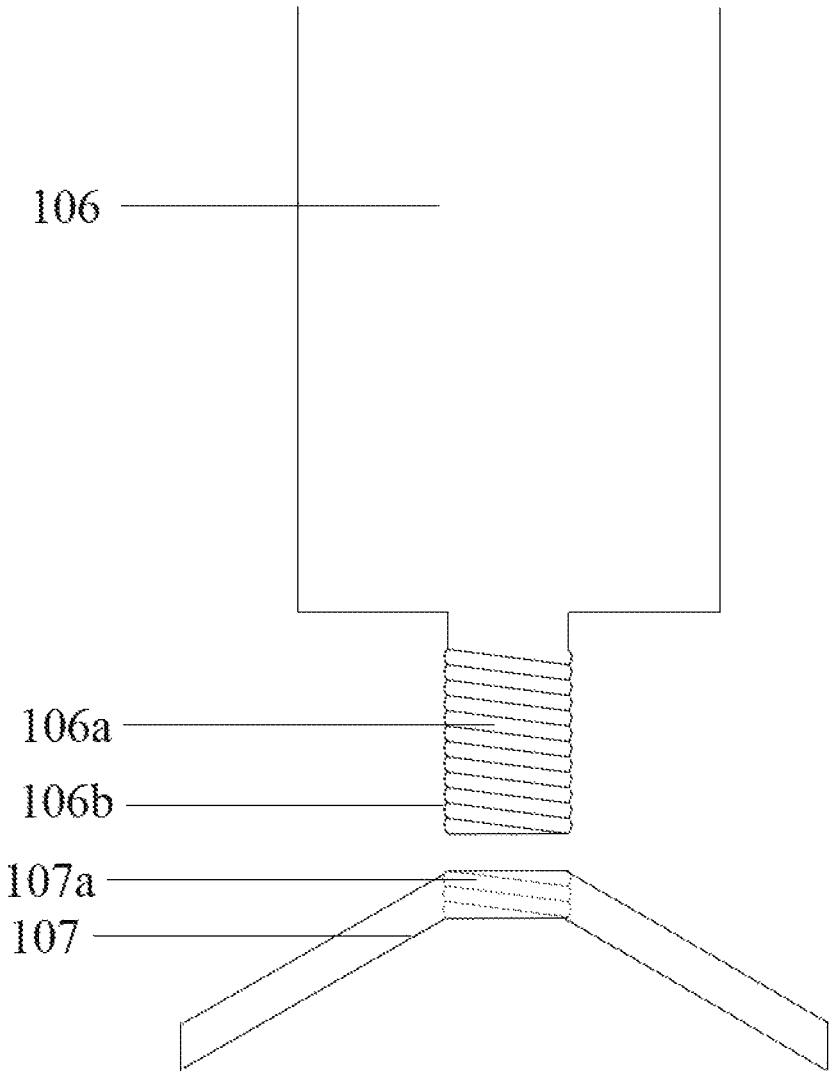
FIG. 3 is a top view illustrating a first connection implementation between a knob structure and a linear light source in a transparent window display apparatus provided by an embodiment of the present invention.
Figure 4:
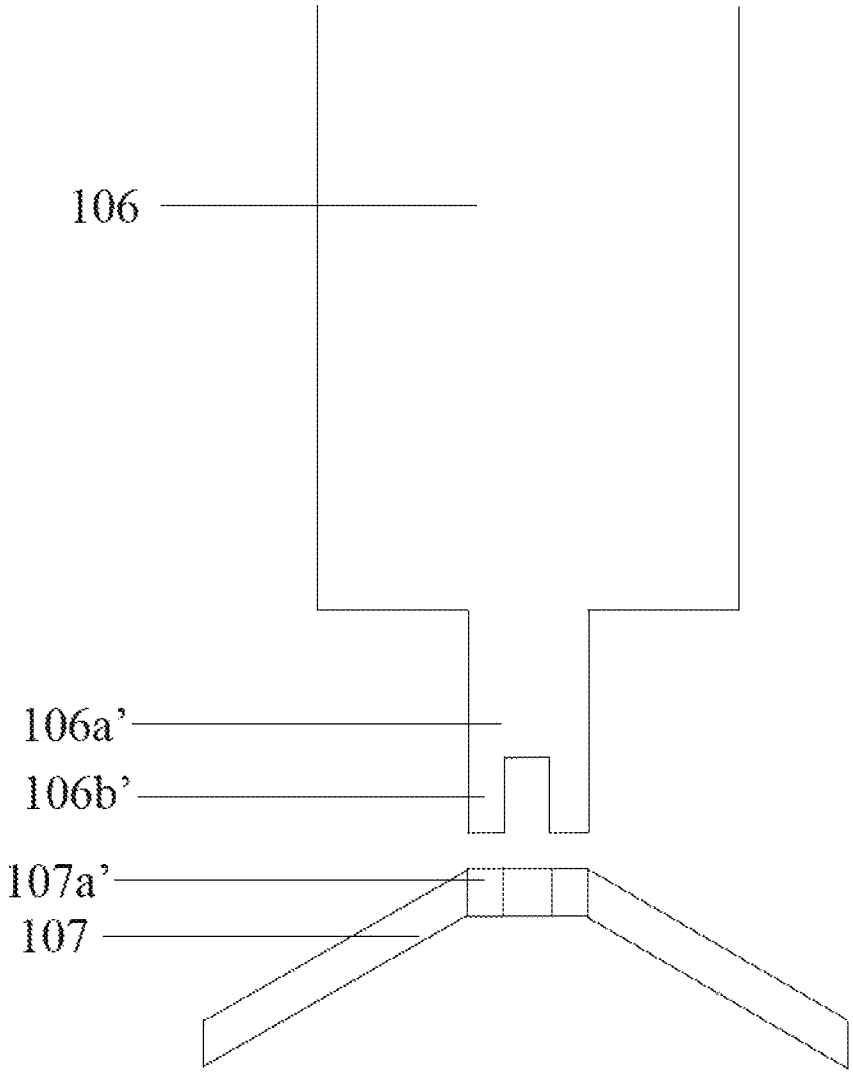
FIG. 4 is a top view illustrating a second connection implementation between a knob structure and a linear light source in a transparent window display apparatus provided by an embodiment of the present invention.

Particularly, the transparent window display apparatus further includes a knob structure 107, which is provided on surfaces of the first side wall 111 and the second side wall 112 facing outside of the transparent window display apparatus and configured to be respectively connected to the two ends of the linear light source to adjust the light-exiting angle of the linear light source. The knob structure 107 and the ends of the linear light source extending out of the two side walls may be connected by mean of screw threads, or may be jointed by way of plugging and pulling, so that in practical use, intensity of light derived from the diffuser plate 108 can be adjusted conveniently by simply adjusting the knob structure 107 at two sides. Specifically, in implementation (1): when the knob structure 107 and the ends of the linear light source extending out of the two side walls are connected by mean of screw threads, a screw hole 107*a* may be provided in the knob structure 107, a hand whose cross-section is an ellipse may be provided outside the knob structure 107, and the screw hole 107*a* provided in the knob structure 107 and screw threads 106*b* on a surface of the first protrusion 106*a* at the end of the linear light source extending out of the side wall cooperate with each other to be tightened, as shown in FIG. 3; in implementation (2): when the knob structure 107 and the ends of the linear light source extending out of the two side walls are jointed by way of plugging and pulling, a slot 107*a*' may be provided in the knob structure 107, a hand whose cross-section is an ellipse may be provided outside the knob structure 107, the slot 107*a*' and a pattern 106*b*' of a surface of the second protrusion 106*a*' at the end of the linear light source extending out of the side wall match in size and shape, and when rotating the knob structure 107, because their rotating cross-sections perpendicular to each other are asymmetric, the knob structure 107 can rotate surfaces of the prismatic structure of the linear light source inside the transparent window display apparatus, so as to change the light-exiting angle of the linear light source as well as the intensity and light-exiting angle of light finally reaching the diffuser plate, as shown in FIG. 4. The implementation (1) can achieve better fastening effect, so that the knob structure 107 can hardly fall off; the implementation (2) is more convenient and simplifies disassembly.

The number of the linear light sources may be arbitrarily set according to size of the internal space and demands on environment, and is not limited in the present invention.

Particularly, in a case where the transparent window display apparatus includes at least two linear light sources, the linear light sources are arranged sequentially in a direction from the back plate 103 to the transparent display screen 101 and between the top plate 104 and diffuser plate 108, and a distance of the linear light source from the top plate 104 decreases as a distance of the linear light source from the back plate 103 increases. Here, distances of the at least two linear light sources from the diffuser plate 108 may keep unchanged, and in this case, as shown in FIG. 2, it can be seen from a side view that a line connecting the linear light sources is parallel to the diffuser plate 108; in addition, the distances of the at least two linear light sources from the diffuser plate 108 may vary, from the perspective of the side view, an extended line of the top plate 104 and an extended line of the diffuser plate 108 form an angle, and the line connecting the at least two linear light sources overlaps with the bisector of the angle (not shown in figures). The above two configurations can both allow light from the light sources to be mixed more adequately between the diffuser plate 108 and the top plate 104, and selection between the configurations may be made depending on practical conditions. Further, in order that light can be mixed even more adequately, an inner side of the top plate 104 is preferably a shining reflective surface. To avoid light leakage, black elastic sealing element, e.g., black rubbers, are provided at positions where the diffuser plate 108 is in contact with the two side walls. Preferably, the linear light source is an LED lamp.

Figure 5:
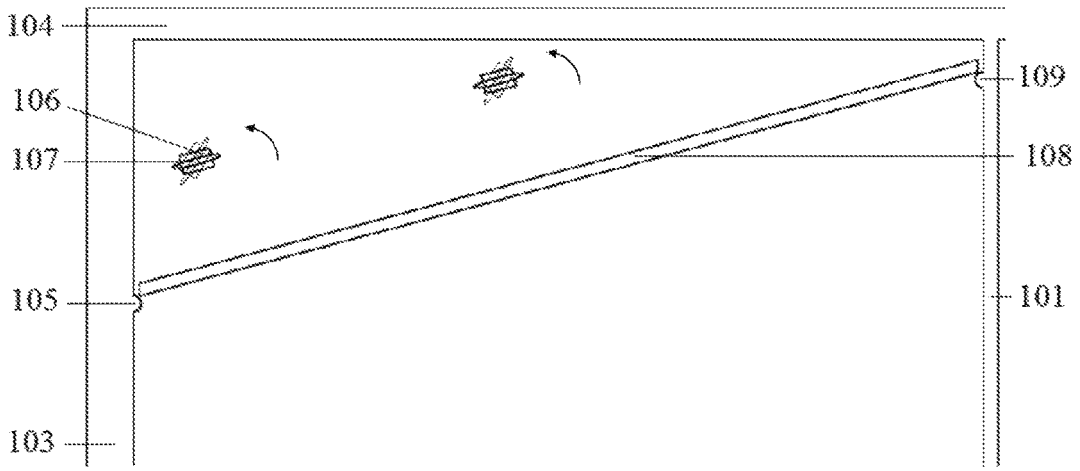
FIG. 5 is a schematic diagram illustrating separate adjustment of light intensity and light-exiting angle in a transparent window display apparatus provided by an embodiment of the present invention.

Preferably, the transparent display screen 101 is a liquid crystal display screen. The light source 106 and the diffuser plate 108 in the transparent window display apparatus, together serving as a backlight source, provide backlight for the transparent display screen 101. Similarly, light having required light intensity and light-exiting angle can be provided to the transparent display screen 101 as required by adjusting the knob structure 107 at two sides of the transparent window display apparatus. As shown in FIG. 5, when the knob structure 107 is at a first position indicated by a solid line, the relatively large surface (light-exiting surface) of the linear light source of a cuboid shape is parallel to the plane of the diffuser plate; when the knob structure 107 is at a second position indicated by a dotted line, the relatively large surface (light-exiting surface) of the linear light source of a cuboid shape is not parallel to the diffuser plate any more, for example, the knob structure 107 is rotated along an arrow direction shown in FIG. 5, and accordingly, intensity of light derived from the diffuser plate 108 is decreased, the light-exiting angle varies and intensity of backlight irradiated on the transparent display screen 101 is decreased.

Figure 6:
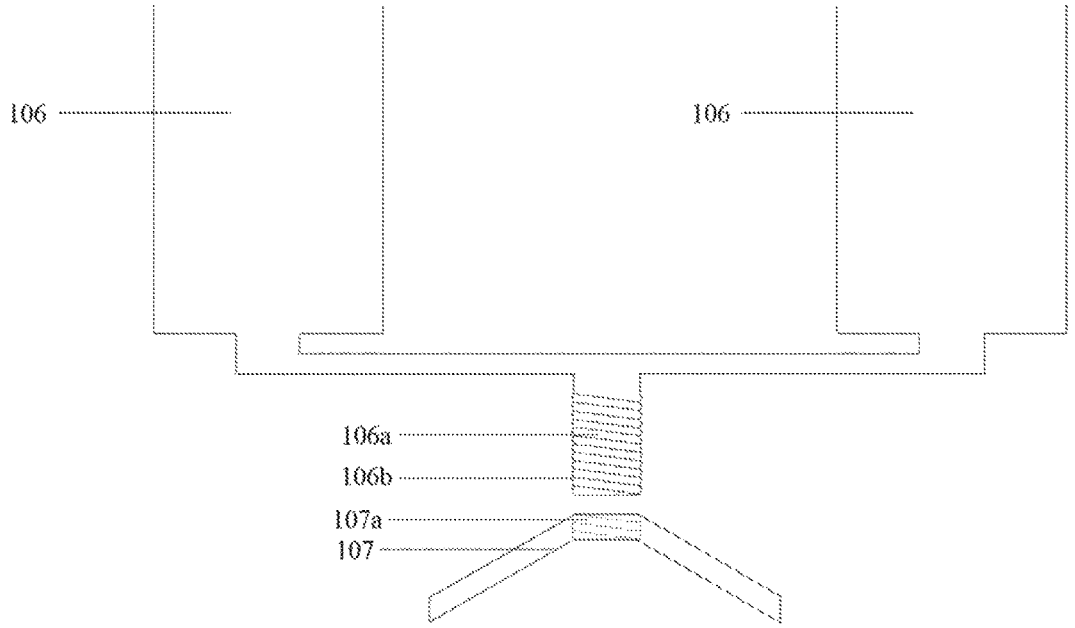
FIG. 6 shows a top view of a knob structure connecting two linear light sources in parallel in a transparent window display apparatus provided by an embodiment of the present invention.
Figure 7:
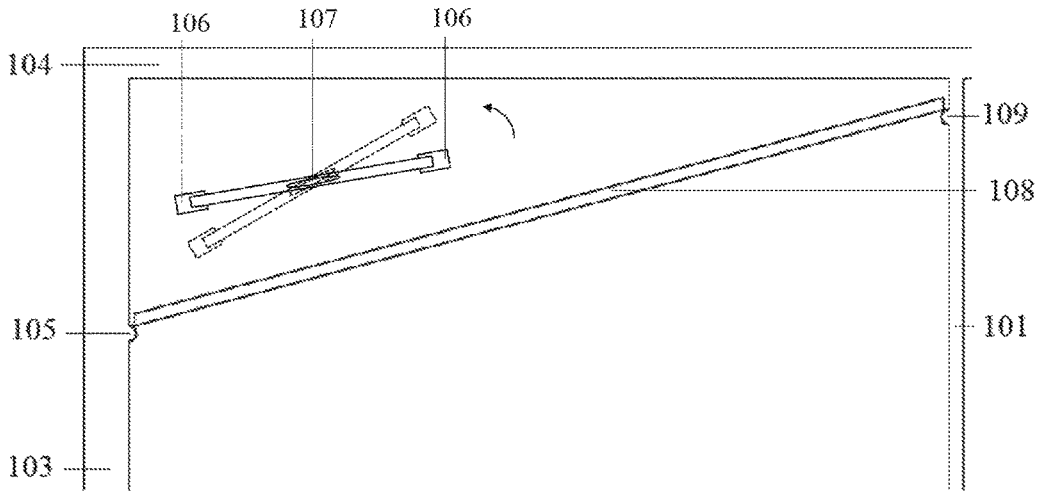
FIG. 7 is a schematic diagram illustrating simultaneous adjustment of light intensity and light-exiting angle in a transparent window display apparatus provided by an embodiment of the present invention.

In addition, as shown in FIG. 6, when the number of the linear light sources 106 is no less than two, the linear light sources may be connected in parallel, and two ends shared by the linear light sources connected in parallel extend out of the first side wall and the second side wall of the transparent window display apparatus to be connected to the knob structure 107, respectively. In this case, optical properties, such as light-exiting angle and light intensity, of light from two linear light sources can be changed at the same time by simply adjusting one knob structure 107. As shown in FIG. 7, the linear light source 106 and the knob structure 107 rotate from a first position indicated by a solid line to a second position indicated by a dotted line, and accordingly intensity and light-exiting angle of light derived from the diffuser plate 108 are changed.

Figure 8:
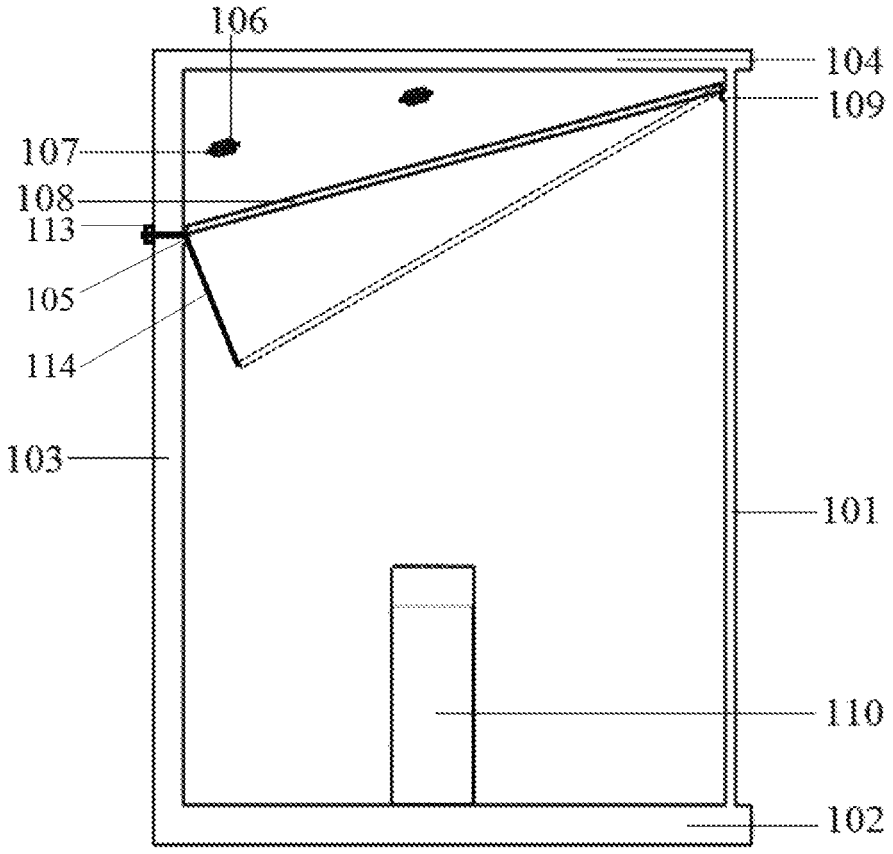
FIG. 8 is a schematic diagram illustrating adjustment of an angle between a diffuser plate and a back plate in a transparent window display apparatus provided by an embodiment of the present invention.

Moreover, in addition to adjusting the knob structure 107 to adjust the light-exiting angle of the linear light source, as shown in FIG. 8, it is also feasible to adjust relative position between the diffuser plate 108 and the back plate 103. It should be noted that, since the diffuser plate 108 has a fixed size, an angle between the diffuser plate 108 and the back plate 103 described herein refers to an angle formed between an extended line of the diffuser plate 108 and an extended line of the back plate 103. To avoid light leak caused by adjusting the angle between the diffuser plate 108 and the back plate 103, in this case, the back plate 103 is provided thereon with an adjustment mechanism 113, with the adjustment mechanism 113, a black elastomer 114 whose tail end is connected to an end of the diffuser plate 108 close to the back protrusion 105 can be led out, the black elastomer 114 may take the back protrusion 105 as a pivot, and the angle between the diffuser plate 108 and the back plate 103 can be controlled by controlling a length of the black elastomer 114 that has been led out.

With the above configuration, the transparent window display apparatus in the embodiments of the present invention provides an excellent way to show an exhibit such as a product, that is, the light source between the back plate and the diffuser plate provides planar light for exhibit show and the transparent display screen simultaneously, and by using the light source in the transparent window, specific introduction of information such as pictures, animations, advertisements, and the like can be displayed while achieving appearance show of an exhibit like a product, thereby achieving the purpose of product promotion. By using the design of transparent window display apparatus in the present invention, costs can be saved, convenience can be provided and efficiency can be improved.

Obviously, those of ordinary skill in the art can make various modifications and variations without departing from the spirit and scope of the present invention. Thus, if these modifications and variations to the present invention fall into the scope of the appended claims of the present invention and its equivalents, the present invention is intended to cover these modifications and variations.

The invention claimed is:

1. A transparent window display apparatus, comprising a transparent display screen, a top plate, a back plate, a base, a first side wall and a second side wall, wherein the transparent display screen and the back plate are opposite to each other and respectively located on front and back of the transparent window display apparatus, the base and the top plate are opposite to each other and respectively located at bottom and top of the transparent window display apparatus, the first side wall and the second side wall are opposite to each other and respectively located on two sides of the transparent window display apparatus, and the transparent display screen, the top plate, the back plate, the base, the first side wall and the second side wall form an internal space for accommodating an exhibit, wherein the transparent window display apparatus further comprises a diffuser plate in the internal space, the diffuser plate and the back plate forming an angle; and a light source between the top plate and the diffuser plate, wherein the diffuser plate is configured to diffuse light emitted from the light source, so as to obtain desirable light to show the exhibit and/or provide backlight for the transparent display screen;

the diffuser plate is arranged above the exhibit; and the angle between the diffuser plate and the back plate ranges from 60 degrees to 80 degrees.

2. The transparent window display apparatus according to claim 1, wherein optical elements of lens or prisms arranged periodically are provided on a surface of the diffuser plate facing the light source.

3. The transparent window display apparatus according to claim 1, wherein the light source comprises one or more linear light sources.

4. The transparent window display apparatus according to claim 3, wherein the linear light source is of a prismatic structure.

5. The transparent window display apparatus according to claim 3, wherein each of the linear light sources is parallel to the diffuser plate; and two ends of each of the linear light sources respectively extend out of the first side wall and the second side wall of the transparent window display apparatus, or when the light source comprises at least two linear light sources, the at least two linear light sources are connected in parallel, and two ends shared by the at least two linear light sources connected in parallel respectively extend out of the first side wall and the second side wall of the transparent window display apparatus.

6. The transparent window display apparatus according to claim 5, further comprising a knob structure, which is provided on surfaces of the first side wall and the second side wall facing outside of the transparent window display apparatus and configured to be respectively connected to the two ends to adjust a light-exiting angle of the linear light source.

7. The transparent window display apparatus according to claim 6, wherein the knob structure and the two ends are connected by means of screw threads or jointed by way of plugging and pulling.

8. The transparent window display apparatus according to claim 3, wherein the light source comprises at least two linear light sources, the at least two linear light sources are arranged sequentially in a direction from the back plate to the transparent display screen and between the top plate and the diffuser plate, and a distance of the linear light source from the top plate decreases as a distance of the linear light source from the back plate increases.

9. The transparent window display apparatus according to claim 1, wherein the back plate is a transparent back plate.

10. The transparent window display apparatus according to claim 1, wherein the first side wall and the second side wall are transparent side walls.

11. The transparent window display apparatus according to claim 1, wherein inner sides of the transparent display screen and the back plate are respectively provided with a front protrusion and a back protrusion to secure the diffuser plate.

12. The transparent window display apparatus according to claim 11, wherein the back plate is provided thereon with an adjustment mechanism configured to lead out a black elastomer, and a tail end of the black elastomer is connected to an end of the diffuser plate proximal to the back protrusion to adjust the angle between the diffuser plate and the back plate.

13. The transparent window display apparatus according to claim 3, wherein the light source comprises at least two linear light sources, which are arranged sequentially in a direction from the back plate to the transparent display screen and between the top plate and the diffuser plate, an extended line of the top plate and an extended line of the diffuser plate form an angle, and a line connecting the at least two linear light sources overlaps with a bisector of the angle.

14. The transparent window display apparatus according to claim 1, wherein an inner side of the top plate is a specular reflection surface.

15. The transparent window display apparatus according to claim 3, wherein the linear light source is a columnar light source.

16. The transparent window display apparatus according to claim 4, wherein the linear light source is of a cuboid structure.

17. A method for adjusting light derived from the diffuser plate in the transparent window display apparatus according to claim 1, comprising:

adjusting light derived from the diffuser plate by adjusting light intensity and/or a light-exiting angle of light emitted from the light source and by adjusting the angle between the diffuser plate and the back plate.

18. The method according to claim 17, wherein the light source comprises one or more linear light sources, which are parallel to the diffuser plate and are of cuboid structures, and the method comprises:

in an initial phase, keeping a relatively large surface, which is a light-exiting surface, of the linear light source of a cuboid structure parallel to a plane of the diffuser plate so that intensity of light derived from the diffuser plate has a maximum value; and in a use phase, rotating two ends of the linear light source extending out of the first side wall and the second side wall to drive the linear light source to rotate inside the transparent window display apparatus, so that the relatively large surface, which is the light-exiting surface, of the linear light source of the cuboid structure is not parallel to the plane of the diffuser plate any more, thereby obtaining desirable light intensity and/or light-exiting angle of light derived from the diffuser plate.

19. A method for adjusting light derived from the diffuser plate in the transparent window display apparatus according to claim 2, comprising:

adjusting light derived from the diffuser plate by adjusting light intensity and/or a light-exiting angle of light emitted from the light source and by adjusting the angle between the diffuser plate and the back plate.

20. The method according to claim 19, wherein the light source comprises one or more linear light sources, which are parallel to the diffuser plate and are of cuboid structures, and the method comprises:

in an initial phase, keeping a relatively large surface, which is a light-exiting surface, of the linear light source of a cuboid structure parallel to a plane of the diffuser plate so that intensity of light derived from the diffuser plate has a maximum value; and in a use phase, rotating two ends of the linear light source extending out of the first side wall and the second side wall to drive the linear light source to rotate inside the transparent window display apparatus, so that the relatively large surface, which is the light-exiting surface, of the linear light source of the cuboid structure is not parallel to the plane of the diffuser plate any more, thereby obtaining desirable light intensity and/or light-exiting angle of light derived from the diffuser plate.

* * * * *